US008511922B2

(12) United States Patent
Prischak

(10) Patent No.: US 8,511,922 B2
(45) Date of Patent: Aug. 20, 2013

(54) APPLICATORS AND ASSEMBLY, FILLING, AND DISPENSING METHODS

(75) Inventor: Joseph J. Prischak, Erie, PA (US)

(73) Assignee: Plastek Industries, Inc., Erie, PA (US)

( * ) Notice: Subject to any disclaimer, the term of this patent is extended or adjusted under 35 U.S.C. 154(b) by 0 days.

(21) Appl. No.: 13/637,376

(22) PCT Filed: Oct. 28, 2011

(86) PCT No.: PCT/US2011/058276

§ 371 (c)(1),
(2), (4) Date: Sep. 26, 2012

(87) PCT Pub. No.: WO2012/058530

PCT Pub. Date: May 3, 2012

(65) Prior Publication Data

US 2013/0014366 A1 Jan. 17, 2013

Related U.S. Application Data

(60) Provisional application No. 61/407,665, filed on Oct. 28, 2010.

(51) Int. Cl.
*B43K 23/00* (2006.01)

(52) U.S. Cl.
USPC ..... 401/98; 401/59; 401/175

(58) Field of Classification Search
USPC ..... 401/59, 60, 98, 175, 202, 213, 243, 401/247
See application file for complete search history.

(56) References Cited

U.S. PATENT DOCUMENTS

| | | | | |
|---|---|---|---|---|
| 3,429,643 | A | 2/1969 | Seaver | |
| 3,612,705 | A | 10/1971 | Duval | |
| 3,623,822 | A | 11/1971 | Davidson | |
| 4,369,158 | A | 1/1983 | Woodruff et al. | |
| 4,932,803 | A | 6/1990 | Goldberger et al. | |
| 5,137,185 | A | 8/1992 | Mitchell | |
| 5,505,041 | A | 4/1996 | Harlan | |
| 5,547,301 | A | 8/1996 | Kageyama et al. | |
| 5,868,510 | A | 2/1999 | Lacout et al. | |
| 6,019,535 | A * | 2/2000 | Turner | 401/52 |
| 6,039,483 | A | 3/2000 | Szekely | |
| 6,299,369 | B1 | 10/2001 | Baines et al. | |
| 6,550,999 | B2 | 4/2003 | Petit et al. | |
| 7,329,063 | B2 | 2/2008 | Kato | |

FOREIGN PATENT DOCUMENTS

| | | | |
|---|---|---|---|
| KR | 20-2010-0002327 | U | 3/2010 |
| WO | 01-34715 | A2 | 5/2001 |

OTHER PUBLICATIONS

International Search Report and Written Opinion for PCT/US2011/058276, dated May 14, 2012.

* cited by examiner

*Primary Examiner* — David Walczak
(74) *Attorney, Agent, or Firm* — Buchman & LaPointe, P.C.

(57) ABSTRACT

A dispenser (20) has a barrel (24; 198), a piston (28) upwardly movable within the barrel from a first position to a second position, and a body (22) of personal care composition at least partially within the barrel between the piston and the barrel top end (44). An actuator is coupled to the piston to shift the piston upward (toward the top end). The actuator comprises a screw member having a threaded first portion (36) engaged to the piston for relative rotation about a first axis (500). The screw has a second portion (50). A cap (60) has a first condition mounted at the barrel top end. The cap has a socket (82) in an outer surface. The cap is removable from the first condition and installable into a second condition. In the cap second condition, the socket receives the screw member second portion to emit a user-induced rotation of the cap about the first axis to, in turn, rotate the first portion.

11 Claims, 6 Drawing Sheets

APPLICATORS AND ASSEMBLY, FILLING, AND DISPENSING METHODS

CROSS-REFERENCE TO RELATED APPLICATION

Benefit is claimed of U.S. patent application Ser. No. 61/407,665, filed Oct. 28, 2010, and entitled "Applicators and Assembly, Filling, and Dispensing Methods", the disclosure of which is incorporated by reference herein in its entirety as if set forth at length.

BACKGROUND OF THE INVENTION

The invention relates to personal care. More particularly, the invention relates to applicators for underarm antiperspirant and/or deodorant.

A well-developed art exists regarding dispenser/applicators for personal care products. One particular area involves applicators for solid or gel antiperspirant and/or deodorant compositions. Applicators for solid and gel compositions are typically generally similar to each other, with a piston (platform) upwardly movable within a cylinder (barrel) to progressively drive the composition out the barrel upper end. Due to the relative lack of stiffness of many gels and soft solids, dispensers for such compositions commonly include apertured applicator elements across the upper end of the barrel.

Dispenser/applicators are disclosed in U.S. Pat. No. 6,039,483 (the '483 patent) entitled "Rotary Dispenser", and U.S. Pat. No. 4,932,803 (the '803 patent), entitled "Stick Dispenser", the disclosures of which are incorporated by reference herein in their entireties as if set forth at length.

SUMMARY OF THE INVENTION

One aspect of the disclosure involves a dispenser having a barrel, a piston upwardly movable within the barrel from a first position to a second position, and a body of personal care composition at least partially within the barrel between the piston and the barrel top end. An actuator is coupled to the piston to shift the piston upward (toward the top end). The actuator comprises a screw member having a threaded first portion engaged to the piston for relative rotation about a first axis. The screw has a second portion. A cap has a first condition mounted at the barrel top end. The cap has a socket in an outer surface. The cap is removable from the first condition and installable into a second condition. In the cap second condition, the socket receives the screw member second portion to emit a user-induced rotation of the cap about the first axis to, in turn, rotate the first portion.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
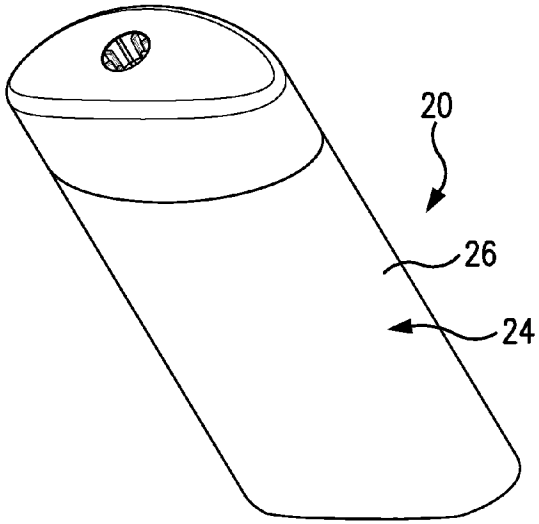
FIG. 1 is a view of a personal care product dispenser/applicator in a closed condition.
Figure 2:
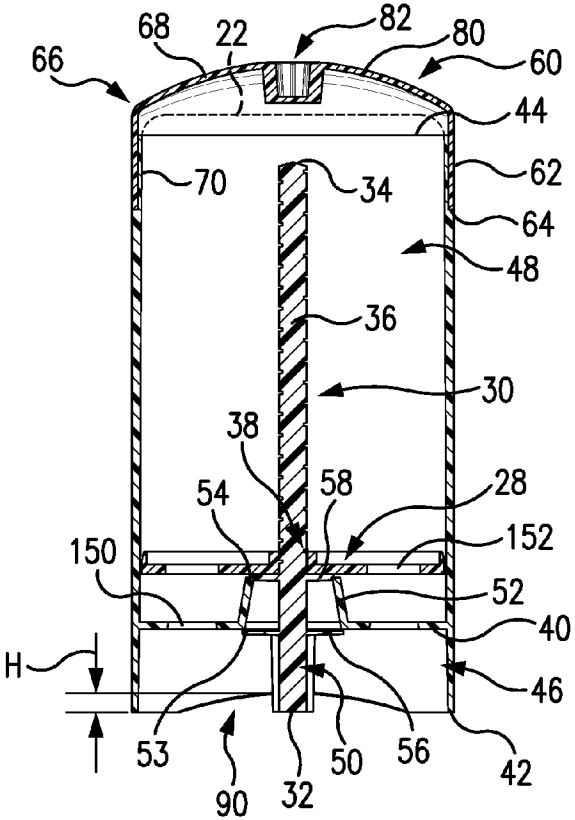
FIG. 2 is a transverse central longitudinal/vertical sectional view of the dispenser/applicator of FIG. 1.
Figure 5:
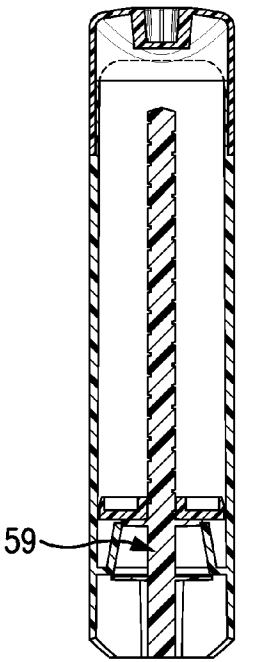
FIG. 5 is a second transverse central longitudinal/vertical sectional view of the dispenser/applicator of FIG. 1.
Figure 6:
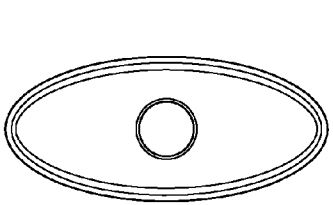
FIG. 6 is a bottom view of a cap of the dispenser/applicator of FIG. 1.
Figure 12:
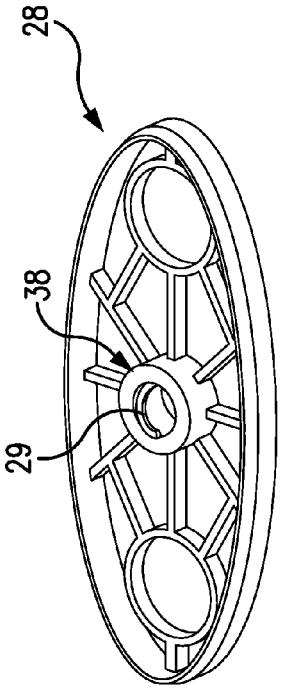
FIG. 12 is a view of a platform of the applicator of FIG. 1.
Figure 15:
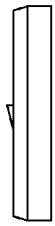
FIG. 15 is a side view of the platform of FIG. 12.
Figure 11:
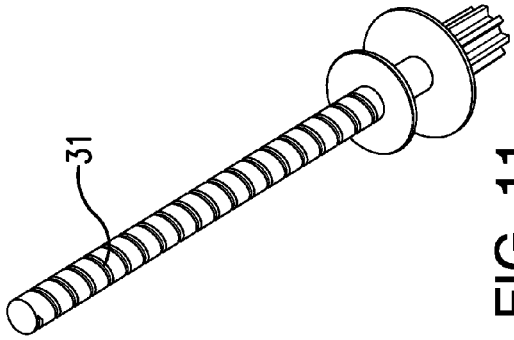
FIG. 11 is a view of an elevator screw of the dispenser/applicator of FIG. 1.
Figure 14:
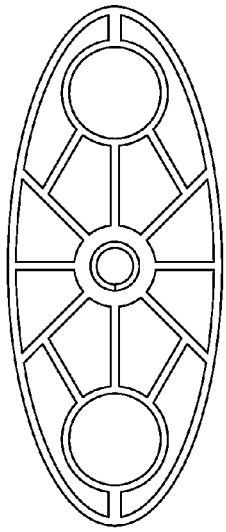
FIG. 14 is a bottom view of the platform of FIG. 12.

FIG. 1 shows a dispenser 20 (often referred to as an applicator) for a personal care product 22 (FIG. 2; e.g., a cream, gel, or soft/semi-solid antiperspirant and/or deodorant). The dispenser 20 includes a body 24 (often identified as a barrel) containing the product 22. The exemplary barrel is formed as a single piece molding. The barrel carries (within a sidewall 26) a platform or piston 28 (having an internal thread 29-FIG. 12) and an elevator screw 30 (having an external thread 31—FIG. 11) for raising the platform to eject the product.

The exemplary screw extends from a lower/bottom end 32 to an upper/top end 34. The exemplary screw has an externally threaded 31 upper portion 36 engaged to a complementary internally threaded 29 central portion 38 (shown as a central boss) of the platform 28. The screw has an axis of rotation 500 which forms a central longitudinal axis of the dispenser. The exemplary screw is captured longitudinally via cooperation with a transverse web 40 of the barrel.

The barrel and its sidewall 26 extend from a lower/bottom end/rim 42 to an upper/top end/rim 44. The web 40 divides the barrel interior into a lower portion 46 and an upper portion 48.

As is discussed further below, the screw has a lower portion 50 bearing interengagement features for engaging a knob to turn the screw to progressively raise the platform and dispense the product.

The exemplary web 40 includes a central collar 52 extending upward from a lower end 53 to an upper end or rim 54. The lower end 53 forms a shoulder of the web. The lower end 53 and upper end 54 respectively cooperate with a lower flange 56 and an upper flange 58 of the screw at ends of an intermediate portion 59. The exemplary underside of the upper flange 58 has a peripheral rebate receiving an inboard peripheral portion of the rim 54. The exemplary upper flange 58 is slightly smaller in diameter than the lower flange 56 allowing it to be installed by passing through the collar (slightly straining/stretching the collar as its upper portion passes through the upper end of the collar).

Figure 4:
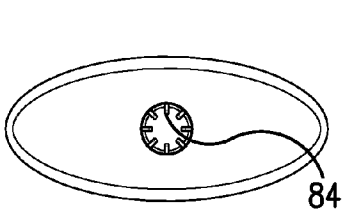
FIG. 4 is a top view of the dispenser/applicator of FIG. 1.
Figure 3:
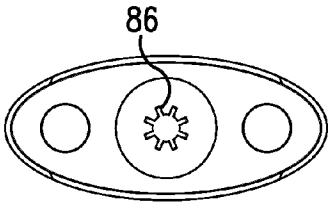
FIG. 3 is a bottom view of the dispenser/applicator of FIG. 1.
Figure 10:
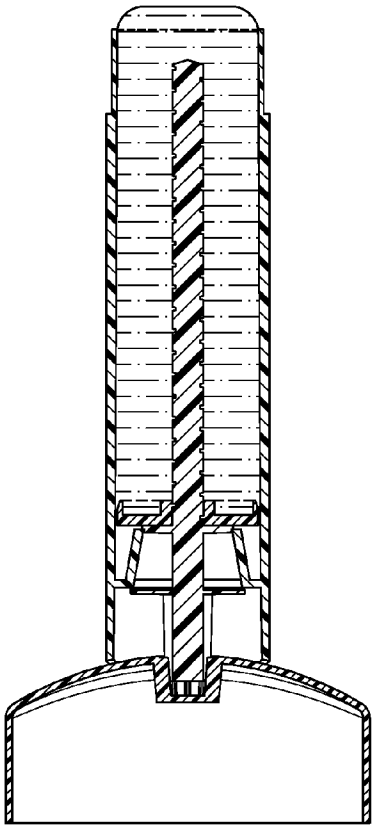
FIG. 10 is a second transverse central longitudinal/vertical sectional view of the dispenser/applicator of FIG. 8.
Figure 9:
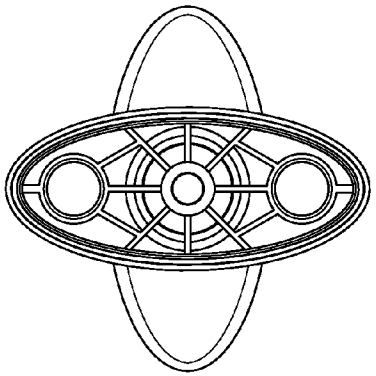
FIG. 9 is a top view of the dispenser/applicator of FIG. 8.
Figure 8:
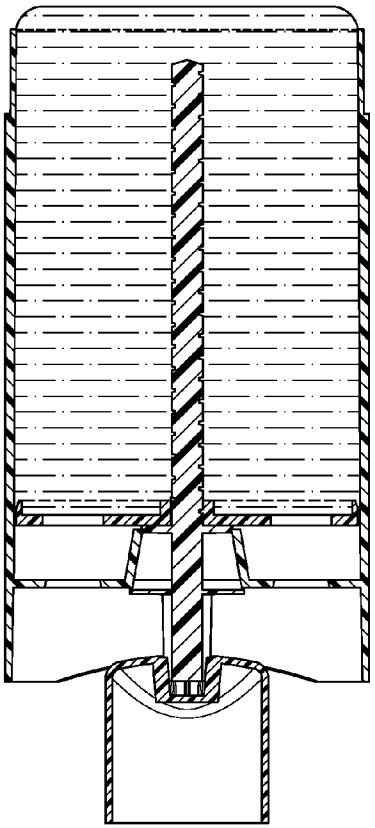
FIG. 8 is a transverse central longitudinal/vertical sectional view of the dispenser/applicator of FIG. 1 in an in-use condition with the cap/knob rotated relative to FIG. 7.
Figure 7:
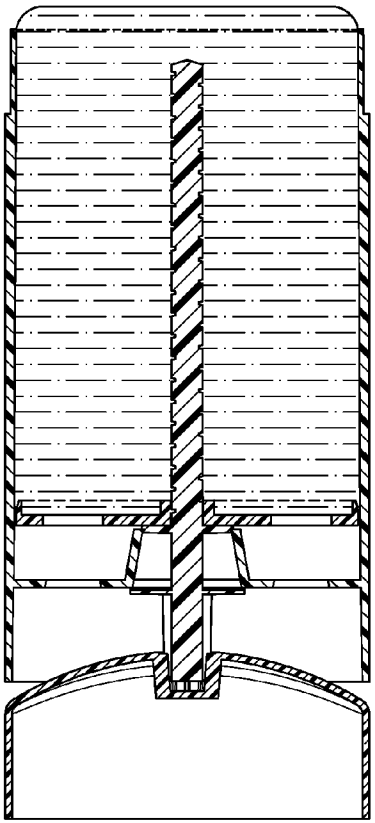
FIG. 7 is a transverse central longitudinal/vertical sectional view of the dispenser/applicator of FIG. 1 in an in-use condition with the cap as a knob.
Figure 13:
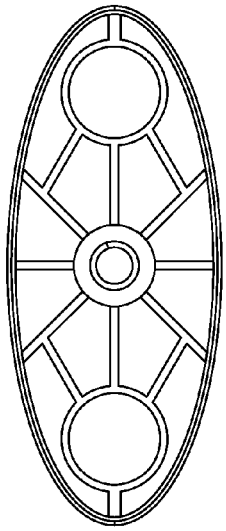
FIG. 13 is a top view of the platform of FIG. 12.
Figure 16:
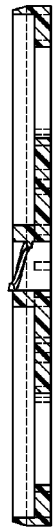
FIG. 16 is a transverse central longitudinal/vertical sectional view of the platform of FIG. 12.

The screw is longitudinally/axially retained in the barrel with freedom to rotate; a peripheral portion of the upper surface of the flange 56 bears against the underside of the shoulder and the peripheral rebate bears against the rim 54. The exemplary knob is formed by a removable cap 60. The cap 60 comprises a sidewall 62 extending upward from a lower rim 64 to an upper end 66 at the periphery of a domed top or upper end 68. A lower portion of the sidewall receives a rebated upper neck portion 70 of the barrel when the cap is in the closed/installed condition. The cap may be detented to the barrel by cooperating projections and recesses. Along the domed upper end 68, a socket 82 is formed in the cap outer surface 80. The exemplary socket 82 has features (e.g., splines 84 (FIG. 4) and associated gaps) complementary to features (e.g., splines 86 (FIG. 3) and associated gaps) of the screw lower portion 50. This allows the cap to be removed and reinstalled in a second condition with the socket 82 receiving the portion 50. Once this is done, the cap may be used as a knob to rotate the screw to dispense product.

The exemplary cap and barrel are near elliptical in cross-section or footprint. To facilitate the rotation, along longer front and back sides (the wider dimension), the lower end of the barrel includes relieved areas 90. Given the doubly convexly domed nature of the cap, the relieved areas allow the cap to rotate in the installed second condition. An exemplary height H or depth of the relieved areas 90 (recesses) continuously transitions from zero at the ends of the relieved areas to a maximum value centrally along the sides of the barrel. An exemplary peak value of H is in excess of 2 mm, more particularly, 3-15 mm or 3-8 mm. An exemplary length of the relieved areas along the curve (if any) of the barrel is in excess of 20 mm, more narrowly, in excess of 30 mm and extends along an exemplary 50-90% of the barrel width, more narrowly, 60-80%.

The exemplary configuration avoids the need for a separate knob. This may save on material costs.

Figure 18:
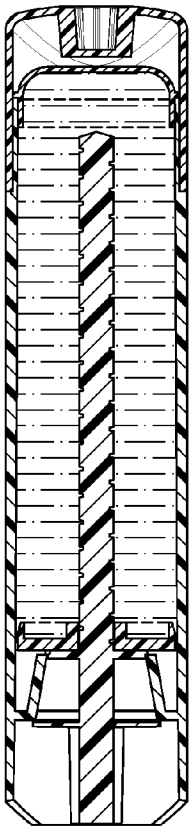
FIG. 18 is a second transverse central longitudinal/vertical sectional view of the dispenser/applicator of FIG. 17.
Figure 17:
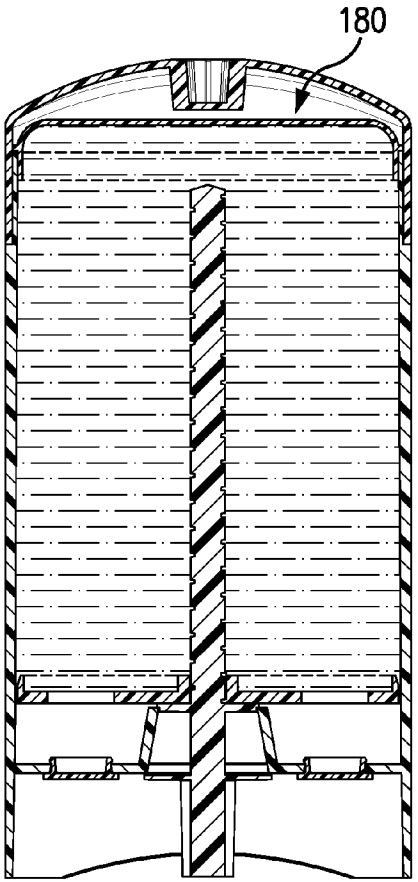
FIG. 17 is a transverse central longitudinal/vertical sectional view of a second dispenser/applicator.
Figure 21:
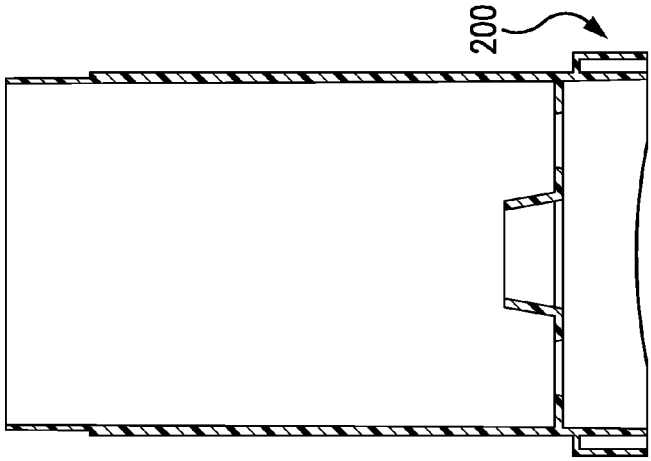
FIG. 21 is a transverse central longitudinal/vertical sectional view of the barrel of FIG. 19.
Figure 20:
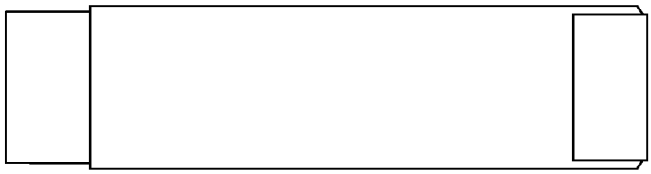
FIG. 20 is a side view of the barrel of FIG. 19.
Figure 23:
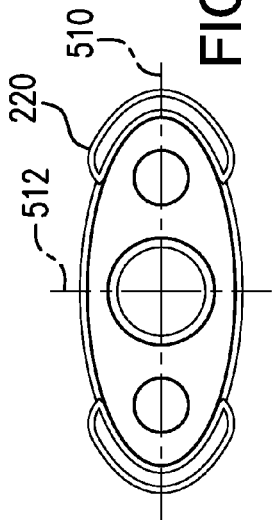
FIG. 23 is a bottom view of the barrel of FIG. 19.
Figure 19:
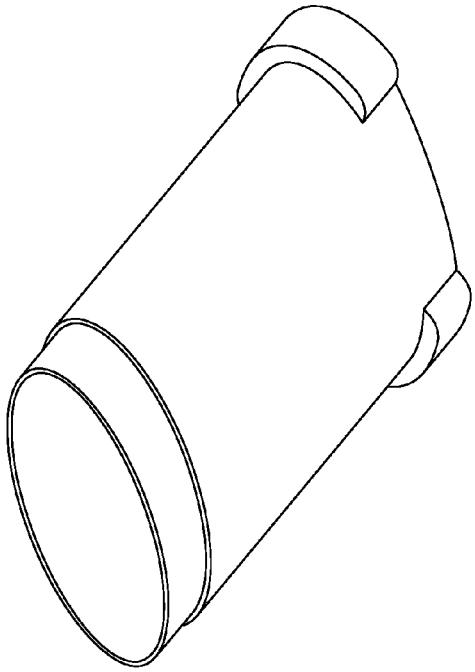
FIG. 19 is a view of an alternate barrel of an alternate dispenser/applicator.
Figure 22:
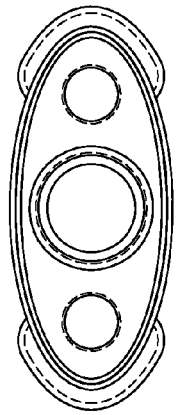
FIG. 22 is a top view of the barrel of FIG. 19.
Figure 26:
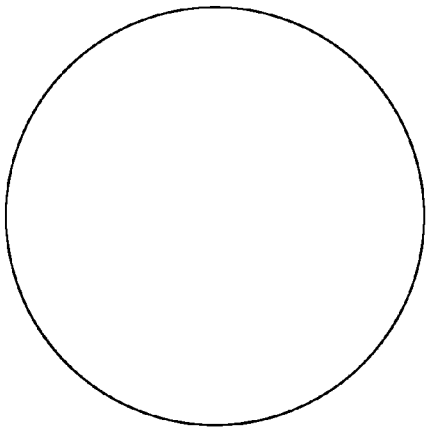
FIG. 26 is a bottom view of the plug of FIG. 24.
Figure 25:
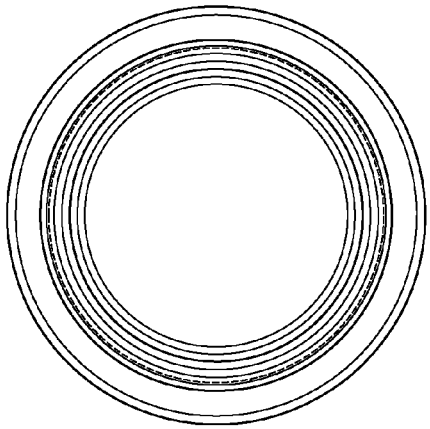
FIG. 25 is a top view of the plug of FIG. 24.
Figure 24:
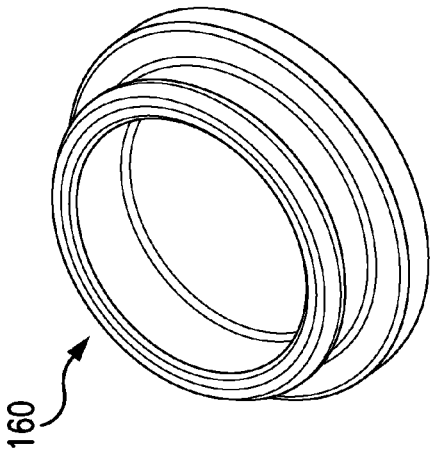
FIG. 24 is a view of a plug for a web of the barrel of the exemplary dispenser/applicators.
Figure 28:
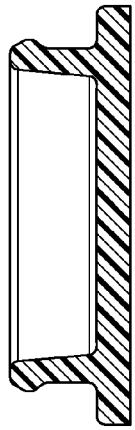
FIG. 28 is a central longitudinal/vertical sectional view of the plug of FIG. 24.
Figure 27:
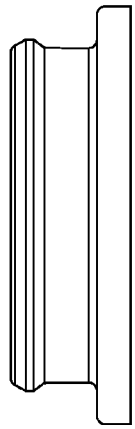
FIG. 27 is a side view of the plug of FIG. 24.

An exemplary filling process involves the applicator in an initial condition with the screw installed to the barrel and platform, the platform in its lowermost pre-use condition, and the cap installed. The filling may be in an inverted orientation (cap-down). The web 40 has one or more exemplary holes 150 which are aligned with one or more associated holes 152 in the platform 28. In the inverted condition, one or more injection nozzles may be inserted through the hole(s) 150 and, optionally through the hole(s) 152. The nozzle(s) may inject the personal care composition. The personal care composition may pour down to the inboard surface of the dome and be molded thereby. Alternatively, FIGS. 17 and 18 show a seal 180 which may be installed prior to filling so as to mold the ultimate upper surface of the product. The seal may be removed and disposed of as part of the first use. Alternatively, during injection, the cap may not yet be installed and the barrel may be mounted in a fixture (not shown) which has a surface near the barrel upper end 44 to mold the composition. After the composition has set, the cap may be installed. For gels, a foraminate applicator may be positioned across the end 44 and may be covered with a foil or other seal to mold or merely retain the composition.

If the nature of the personal care composition is such that leakage might be a problem, after the nozzles are removed, the hole(s) 150 and/or 152 may be plugged (e.g., with molded plastic plugs 160 (FIGS. 17, 18, and 24-28)).

FIGS. 19-23 show an alternate barrel 198 which adds a pair of outrigger portions 200 at a lower end of the sidewall. The outrigger portions provide additional stability (e.g., when placed atop a flat support surface) to replace stability lost in forming the relieved areas. The exemplary outriggers 200 are shown protruding away from both a central longitudinal/vertical plane 510 along which the cross-section is widest and a central longitudinal/vertical plane 512 along which the cross-section is narrowest. Because the relieved areas are on opposite sides of the plane 510, the protrusion away from that plane (e.g., at portions 220) helps provide the stability. The protrusion perpendicular thereto may be an artifact of ease of manufacture of the outriggers (allowing an outboard wall of the outrigger to be generally evenly spaced away from a main portion of the sidewall).

The exemplary barrel, screw, platform, plugs, and cap are each injection molded. Exemplary barrel, cup, screw, and plug material is polypropylene; and platform material is polyethylene. Such molding and assembly may be via conventional techniques.

One or more embodiments of the present invention have been described. Nevertheless, it will be understood that various modifications may be made without departing from the spirit and scope of the invention. For example, when implemented in the context of an existing applicator or a modification of an existing applicator, details of such existing applicator may influence details of any particular implementation. Accordingly, other embodiments are within the scope of the following claims.

What is claimed is:

1. A dispenser (20) comprising:

a barrel (24; 198) having: a bottom end (42); a top end (44); and a sidewall (26) extending between the bottom end and the top end;

a platform (28) upwardly moveable within the barrel from a first position to a second position; and a screw member (30) coupled to the platform to shift the platform upward and comprising:

a threaded first portion (36) engaged to the platform for relative rotation about a first axis (500); and a second portion (50); and a cap (60) having a first condition mounted at the barrel the top end, wherein:

the cap has a socket (82) in an outer surface (80); and the cap is removable from the first condition and installable into a second condition with the socket (82) receiving the screw member second portion (50) to permit a user-induced rotation of the cap about the first axis to, in turn, rotate the first portion and raise the platform.

2. The dispenser of claim 1 wherein:

the barrel bottom end, along front and back, has respective relieved areas (90); and the cap (60) is doubly convex with the relieved areas accommodating rotation of the cap in the second condition.

3. The dispenser (20) of claim 2 wherein:

portions of the barrel beyond the relieved areas allow the barrel to stand on a flat support surface.

4. The dispenser of claim 1 wherein:

the screw member second portion comprises a first mating feature (86); and the cap socket comprises a second mating feature (84) interfitting with the first mating feature in the second condition.

5. The dispenser of claim 4 wherein:

the first and second mating features comprise complementary splines.

6. The dispenser of claim 1 further comprising:

a body (22) of a personal care composition at least partially within the barrel between the platform and the top end.

7. A method for using the dispenser of claim 6, the method comprising:

removing the cap from the first condition;

installing the cap to the second condition; and rotating the cap relative to the body in the first direction so as to raise the platform and drive the body of personal care composition from the barrel upper end.

8. A method for filling the dispenser of claim 6, the method comprising:

receiving the barrel, platform, and screw member; and injecting the personal care composition through a transverse web of the barrel and through the platform.

9. The method of claim 8 wherein:

the injecting is performed with the barrel in a bottom-up orientation.

10. The method of claim 8 further comprising:

after the injecting, plugging at least one hole through which the personal care composition was injected.

11. The method of claim 8 wherein:

the personal care composition is injected while the cap is in the first condition.

* * * * *